US010239064B2

(12) United States Patent
Titorov et al.

(10) Patent No.: US 10,239,064 B2
(45) Date of Patent: Mar. 26, 2019

(54) DEVICE FOR SPRAYING PRESSURIZED MATERIAL

(71) Applicants: Vitaly Ivanovich Titorov, Moscow (RU); Konstantin Maratovich Dragan, Moscow (RU)

(72) Inventors: Vitaly Ivanovich Titorov, Moscow (RU); Konstantin Maratovich Dragan, Moscow (RU)

(73) Assignees: Vitaly Ivanovich Titorov, Moscow (RU); Konstantin Maratovich Dragan, Moscow (RU)

( * ) Notice: Subject to any disclaimer, the term of this patent is extended or adjusted under 35 U.S.C. 154(b) by 0 days.

(21) Appl. No.: 15/556,171

(22) PCT Filed: Mar. 6, 2015

(86) PCT No.: PCT/RU2015/000142
§ 371 (c)(1),
(2) Date: Sep. 6, 2017

(87) PCT Pub. No.: WO2016/144201
PCT Pub. Date: Sep. 15, 2016

(65) Prior Publication Data

US 2018/0043376 A1 Feb. 15, 2018

(51) Int. Cl.
*B05B 1/00* (2006.01)
*E04F 21/02* (2006.01)
(Continued)

(52) U.S. Cl.
CPC ..... *B05B 1/005* (2013.01); *B05B 1/042* (2013.01); *B05B 1/3436* (2013.01); *B05B 5/032* (2013.01);
(Continued)

(58) Field of Classification Search
CPC ..... B05B 1/005; B05B 1/3436; B05B 1/046; B05B 5/032; B05B 7/061; B05D 1/025; B65D 83/753
(Continued)

(56) References Cited

U.S. PATENT DOCUMENTS 2,621,078 A * 12/1952 Wahlin ..... B05B 1/042 239/597
2,755,137 A * 7/1956 Hughf ..... B05B 1/042 239/288.5
(Continued)

FOREIGN PATENT DOCUMENTS

| | | |
|---|---|---|
| CA | 1219177 | 3/1987 |
| WO | 9509057 A1 | 4/1995 |
| WO | 9702896 A1 | 1/1997 |

OTHER PUBLICATIONS

International Preliminary Report on Patentability dated Sep. 21, 2017 corresponding to International application No. PCT/RU2015/000142.

*Primary Examiner* — Viet Le
(74) *Attorney, Agent, or Firm* — Nath, Goldberg & Meyer; Jerald L. Meyer; Stanley N. Protigal

(57) ABSTRACT

Spraying heads may be used in spray guns for applying a pressurized aerosol material in the form of jets or spray. A spraying nozzle for spraying a polyurethane material includes a cylindrical body provided, on a first end, with a base having a mounting aperture extending into the cylindrical body, forming a cavity for arranging a head of a gun. The base of the nozzle is in the form of oppositely-disposed leaves. A second end of the body is provided with a cylindrical shoulder, a through-bore of which is communicated with a V-shaped and laterally non-closed recess at the region of an outlet of the sprayed material. Oppositely arranged plate-like protrusions adjoin a lateral surfaces of
(Continued)

the cylindrical shoulder. A mounting aperture end which adjoins the base has a circumferential cut. The spraying nozzle is provided with an attachment means used when in an inoperative position.

5 Claims, 4 Drawing Sheets

(51) Int. Cl.

| | |
|---|---|
| ***B05B 1/34*** | (2006.01) |
| ***B05B 5/03*** | (2006.01) |
| ***B05D 1/02*** | (2006.01) |
| ***B05B 1/04*** | (2006.01) |
| ***B05B 15/65*** | (2018.01) |
| *B05B 7/06* | (2006.01) |
| *B65D 83/14* | (2006.01) |
| *B05B 15/16* | (2018.01) |

(52) U.S. Cl.
CPC ..... *B05B 15/65* (2018.02); *B05D 1/025* (2013.01); *E04F 21/02* (2013.01); *B05B 7/061* (2013.01); *B05B 15/16* (2018.02); *B65D 83/752* (2013.01); *B65D 83/753* (2013.01)

(58) Field of Classification Search
USPC ..... 239/589, 600
See application file for complete search history.

(56) References Cited

U.S. PATENT DOCUMENTS

| | | | | | |
|---|---|---|---|---|---|
| 2,812,213 | A * | 11/1957 | Bede | B05B 1/02 | 239/544 |
| 4,273,287 | A * | 6/1981 | Huber | B05B 7/0815 | 239/290 |
| 4,618,101 | A * | 10/1986 | Piggott | B05B 1/042 | 239/589 |
| 4,736,892 | A * | 4/1988 | Calder | B05B 15/534 | 239/592 |
| 5,271,566 | A * | 12/1993 | Dederich | B05B 15/652 | 239/600 |
| 5,538,188 | A * | 7/1996 | Simonette | B05B 1/00 | 239/591 |
| 5,642,860 | A * | 7/1997 | Bush | B05B 1/00 | 239/333 |
| 6,261,367 | B1 * | 7/2001 | Donges | B05C 5/0225 | 118/300 |
| 7,128,283 | B1 * | 10/2006 | Shahin | B05B 1/042 | 239/600 |
| 7,648,087 | B2 * | 1/2010 | Horn | B05B 1/02 | 239/594 |
| 8,684,281 | B2 * | 4/2014 | Micheli | B05B 1/00 | 239/1 |
| D723,658 | S * | 3/2015 | Meister | D23/213 | |
| D734,365 | S * | 7/2015 | Maholick | D15/7 | |

* cited by examiner

DEVICE FOR SPRAYING PRESSURIZED MATERIAL

This is a National Phase Application filed under 35 U.S.C. 371 as a national stage of PCT/RU2015/000142, filed Mar. 6, 2015, the content of which is hereby incorporated by reference in its entirety.

FIELD OF THE INVENTION

The present invention relates to a device for spraying an aerosol material by gas pressure applied from within, more particularly to a spraying nozzle used in spray guns for applying a pressurized aerosol material in the form of a jet and/or spray onto various surfaces.

PRIOR ART

An apparatus for spraying an aerosol material from a spray gun is known in the art (see: CA1219177, B05B1/04, Mar. 17, 1987 [1]).

This apparatus for controlled spraying of a pressurized aerosol material [1] from a spray gun comprises a cylindrical body provided with a mounting aperture extending into the cylindrical body and forming a cavity for arranging a head of the spray gun therein, which gun may be attached to a container comprising an aerosol composition; a V-shaped recess is provided in one end portion of the body, which recess is in communication with a through aperture (cavity) designed for arranging the head of the spray gun, the width of this recess increases toward a sprayed material exit; and the end portion of the through aperture (cavity), facing the opposite side relative to a sprayed composition, is made with a variable width increasing toward that side.

When operating this apparatus for spraying [1], users may experience difficulties in joining it with the head of the spray gun, since the apparatus body does not comprise any means that may function as a stop for the user's fingers, thus preventing their sliding along the body, which delays the process of joining the apparatus and carrying out corresponding mounting operations.

Furthermore, in order to improve the operation comfort and increase work efficiency and labor productivity, the structure of this apparatus [1] does not comprise any attachment means. e.g., those attachable to a container or a spray gun for the purpose of quick and timely replacement the damaged apparatus [1] (it is quite possible during its long and continuous operation, e.g., when it is used for applying heat insulation onto rail tank-cars or large dwelling objects for which purpose a large number of standard containers may be required, e.g., more than 100 containers).

So, this apparatus cannot ensure comfort in use either during preliminary manipulations therewith or during applying a sprayed composition relative to a surface.

A spray nozzle for spraying a pressurized material contained in an aerosol container from a spray gun is known in the art (see: U.S. Pat. No. 4,618,101, B05B1/04, 21 Oct. 1986 [2]).

This nozzle [2] for spraying a pressurized material from a spray gun comprises a cylindrical body having an axial bore extending from one its end and terminating prior to its other end, thus forming a cavity for arranging a head of the spray gun, the other end of the body further includes a nose portion which circumferential length is greater than that of the cylindrical body, and the axial bore made therein is in communication at the spray outlet end with a transverse V-shaped groove which width is increased toward the outlet end, and the other end of the bore is in communication with said cavity formed in the cylindrical body.

The configuration of this nozzle [2] enables applying a coating in a predetermined spray pattern onto a surface without forming undesirable spots on a general background.

At the same time, this configuration of the nozzle [2] provides, in order to enhance comfort of its use, the possibility of contact with user's fingers when attaching the nozzle to the head of the gun. This is provided by the fact that a length of circumference of a protrusion made in one end portion of the nozzle is less than a length of circumference of the nozzle cylindrical body, therefore, a shoulder is formed therebetween which may be used as a stop for the user's fingers in order to prevent them from sliding during attachment of the nozzle [2] to the head of the spray gun; but a width of this shoulder does not enable resting user's fingers thereon comfortably, which may negatively affect comfort and a time period spent for preliminary manipulations with the nozzle [2] as well as for its replacement when it is damaged or fails.

Alternatively, this nozzle [2] may be attached to the head of the spray gun by abutting it against a surface; however, in such a case its outlet V-shaped aperture will be damaged since is does not have any protective means and will directly contact a surface selected for abutment.

In addition, the nozzle [2], similarly to the spraying apparatus [1], does not comprise a means for attaching it to an aerosol container or a spray gun, which would facilitate and accelerate the user's actions in replacing the nozzle [2] during labor-consuming and long construction works.

The closest analogue of the claimed invention as to the technical essence is a high pressure paint spraying nozzle assembly (see: U.S. Pat. No. 7,128,283, B05B1/00, 31 Oct. 2006 [3]).

This high pressure paint spraying nozzle assembly [3] comprises a cylindrical housing having a bottom wall with a mounting aperture extending into the cylindrical housing and forming a cavity for arranging a head of the spray gun therein, which spray gun is attached to a container with an aerosol composition; a shoulder is made on the other end of the cylindrical housing in the nozzle [3], the circumferential length of this shoulder being less than that of the cylindrical housing itself; and a bore extending through the housing is in communication with a V-shaped recess which width increases toward the outlet for the sprayed material end; this through bore is in communication at the other end with the cavity formed within the cylindrical housing, oppositely arranged plate-like protrusions adjoin the lateral surfaces of the cylindrical shoulder, the height of these plate-like protrusions is greater than that of the cylindrical shoulder, and cuts are made on their outer lateral sides.

The configuration of the high pressure paint spraying nozzle [3] comprises a V-shaped slot, which width increases toward the outlet for the sprayed material, that is closed on the lateral sides thus narrowing a surface area to be treated with the nozzle significantly, which, in turn, increases a time period required for conducting certain mounting works.

Similarly to the nozzle [2], the nozzle [3] also has a ledge that may be used as an abutment for the user's fingers to facilitate securing the nozzle [3] to a spray gun before operation. This ledge is formed by reducing the cylindrical housing diameter approximately in its central portion. This ledge also cannot be a reliable abutment for the user's fingers when the nozzle [3] is connected to the head of the spray gun since its width is insufficient for ensuring a reliable abutment for the user's fingers.

However, the nozzle [3] may be reliably and quickly secured to the head of the spray gun by way of abutting it against a rigid surface; in such a case a possibility of damaging the V-shaped slot with a width increasing toward the outlet for the sprayed material will be minimal, since this V-shaped slot is protected by the oppositely disposed plate-like protrusions adjoining the lateral sides thereof, the height of said protrusions being greater than that of the cylindrical shoulder.

Furthermore, the paint spraying nozzle assembly [3], similarly to the known solutions [1] and [2], is not provided with a device that may temporarily retain it in close proximity to a user, e.g., on an aerosol container or on a spray gun itself, which would enable the user to join the nozzle [3] before operation or replace it during the operation, for example in a case it is damaged or fully collapsed.

Finally, it may be stated that the known nozzle [3] has a rather complex configuration, not in a form of a single piece, which, in the long run, would result in increase of a time period required for manufacturing it and in a higher cost of this article.

SUMMARY OF THE INVENTION

The present invention is aimed at eliminating drawbacks of the known technical solutions described in the "Prior Art" Section.

Thus, the objective to be solved by this invention is to develop a spraying nozzle for a spray gun, wherein the configuration of the aerosol composition outlet enables to apply a polyurethane composition, in particular a polyurethane heat insulation material, onto a treated surface easily, accurately and with good performance and quality, this configuration has a simple and reliable design, is convenient in operation as well as enables treating surfaces within shortest time periods possible.

The technical effect of the invention, which can be objectively seen after its implementation, is: an improved and simplified process of joining the spraying nozzle and a spray gun, easier replacement of a spraying nozzle for a spray gun for a shorter time period in case when it is damaged or fails during labor-consuming and long construction works, reducing a possibility of damaging the spraying nozzle outlet when it is attached to a spray gun while using a hard surface as an abutment, an increase in an area of sections of a surface to be treated, and improved orientation of a polyurethane composition jet in space for the purpose of applying it uniformly onto a treated surface, improved separation of a pressurized gas, and prevention of removal of high-boiling hydrocarbon foaming agents which facilitate future polymerization and foaming of a product applied onto a treated surface.

This technical effect solving the stated task is achieved due to that the spraying nozzle of a spray gun intended for controlled aerosol spraying of a pressurized polyurethane material comprises a cylindrical body which first end is provided with a base having a mounting aperture extending into the cylindrical body and forming a cavity therein for arranging a head of a gun to be attached to a container with an aerosol composition, which base is made in the form of leaves oppositely situated in the same plane and having a size suitable for resting user's fingers when the head of the gun is introduced into the cavity; the other end of the cylindrical body is provided with a cylindrical shoulder having a diameter that is less than a diameter of the body, the cylindrical body having a through bore made therein, which, at a region where a sprayed material exits the container, communicates with a through V-shaped and laterally non-closed recess which width is increased toward an outlet for the sprayed material; oppositely arranged plate-like protrusions adjoin a lateral surface of the cylindrical shoulder, a height of said protrusions being greater than a height of the cylindrical shoulder, and cuts extending to the other end of the cylindrical body are made in outer lateral sides of said protrusions; a wall of said other end has a thickness ensuring that a length of the through bore made in the cylindrical shoulder is greater than the height of the cylindrical shoulder; an end of the mounting aperture adjoining the base has a circumferential cut, and the leaves of the base are provided with an anti-slip finish; and the spraying nozzle is further provided with an attachment means used when in inoperative position.

Preferably, the attachment means for attaching to an aerosol container is designed so that the spraying nozzle in a plan view thereof has the shape of a staple or similar thereto.

According to a particular embodiment of the invention, the attachment means is made as a rod which end face is provided with an arrow-like tip, and a stop made as a crossbar is provided opposite to the arrow-like tip and perpendicular to the rod.

The spraying nozzle of a spray gun for controlled aerosol spraying of a pressurized material according to the invention is made as a single piece in a form of a cylindrical body having a base with a mounting aperture on its first end. The base is made as leaves with an anti-slip finish arranged oppositely in the same plane and extending beyond the cylindrical body; a size of the leaves is suitable for resting user's fingers while the head of the spray gun is introduced into the nozzle cavity. This structural embodiment provides a reliable support for the user's fingers and allows their comfortable contact with a surface of the leaves, thus creating a convenient rest enabling to attach the spraying nozzle to the head of the spray gun quickly and easily prior to operation or during it when it is necessary to replace one spraying nozzle with a new one without interrupting the operation process for a long time; and the anti-slip finish ensures additional stability for the user's fingers in cases when the user can sweat during a labor-consuming work of applying an aerosol composition onto a surface.

The base of the spraying nozzle is provided with a mounting aperture extending into the cylindrical body and forming a cavity there, said cavity being used for accommodation of the head of the spray gun. Dimensions of the cavity are selected so as to ensure reliable and quick attachment and detachment of the head of the spray gun; which is subsequently attached to a container, in particular an aerosol container comprising a polyurethane composition.

The other end of the cylindrical body is provided with a cylindrical shoulder which diameter is less than the diameter of the cylindrical body. A through bore is made in the cylindrical shoulder, which bore is in communication with the cavity formed in the cylindrical body, and on its other end, at the region where a sprayed material exits the container, in communication with a V-shaped recess which width is increased toward the outlet for the sprayed material. Furthermore, a most important feature of this invention is that the wall of the other end (where the cylindrical shoulder is made) has a thickness which can ensure that a length of the through bore made in the cylindrical shoulder is greater than the height of the cylindrical shoulder. It was already mentioned that one of the most important tasks for the inventors was to develop a configuration of the spraying nozzle aperture intended for exit (distribution) of a composition, which configuration should enable applying a polyurethane composition, in particular a single-component polyurethane-foam heat insulation material, quickly, uniformly and with good quality. So, the inventors surprisingly found that the proposed configuration of the V-shaped and laterally non-closed recess which width is increased toward the outlet for the sprayed material and which is in communication with the through bore made in the cylindrical shoulder, in combination with the fact that the end wall where the cylindrical shoulder is made should have a certain thickness ensuring that the length of the through bore made in the cylindrical shoulder is greater than the latter's height can ensure, together, the best orientation of a prepolymer directed jet in space for applying a sprayed composition onto a surface quickly and uniformly as well as can make it stable for "curing", that is, in other words, for separation of excess high-pressure gas, which is required for expelling a polymer.

However, high-boiling hydrocarbon foaming agents are not removed which facilitate further polymerization and foaming of a product applied onto a surface. Thus, a polyurethane material may be applied onto a treated surface quickly, uniformly and with good quality.

According to the invention, oppositely arranged plate-like protrusions abut upon the lateral surface of the cylindrical shoulder. The height of the protrusions is selected so it is greater than the height of the cylindrical shoulder. This feature is conditioned by the fact that these plate-like protrusions prevent contact damage of the V-shaped and laterally non-closed recess when it is joined with the head of the spray gun and a hard surface is used as a support, where the absence of such protective protrusions may lead to a damage of the V-shaped recess which width is made increasing toward a composition spray.

The provision of the end of the mounting aperture, which abuts against the base having a circumferential cut, ensures easier and smother positioning when joining the head of the spray gun and the spraying nozzle, respectively.

A particularly important structural feature of the claimed invention is that the claimed spraying nozzle is provided with a means for attaching it temporarily to an aerosol container or the spray gun, when the nozzle is in its inoperative position; this enables the user to join the nozzle quickly and easily prior to operation or replace it during operation, for example in case when it is damaged or fails. In addition to the above, it is preferable if the means for attachment to an aerosol container is made so that the spraying nozzle in a plan view has the shape of a staple or similar thereto, which can create an impression that it is a cheap, conventional, readily accessible and simple in use product.

BEST MODE OF CARRYING OUT THE INVENTION

Figure 1:
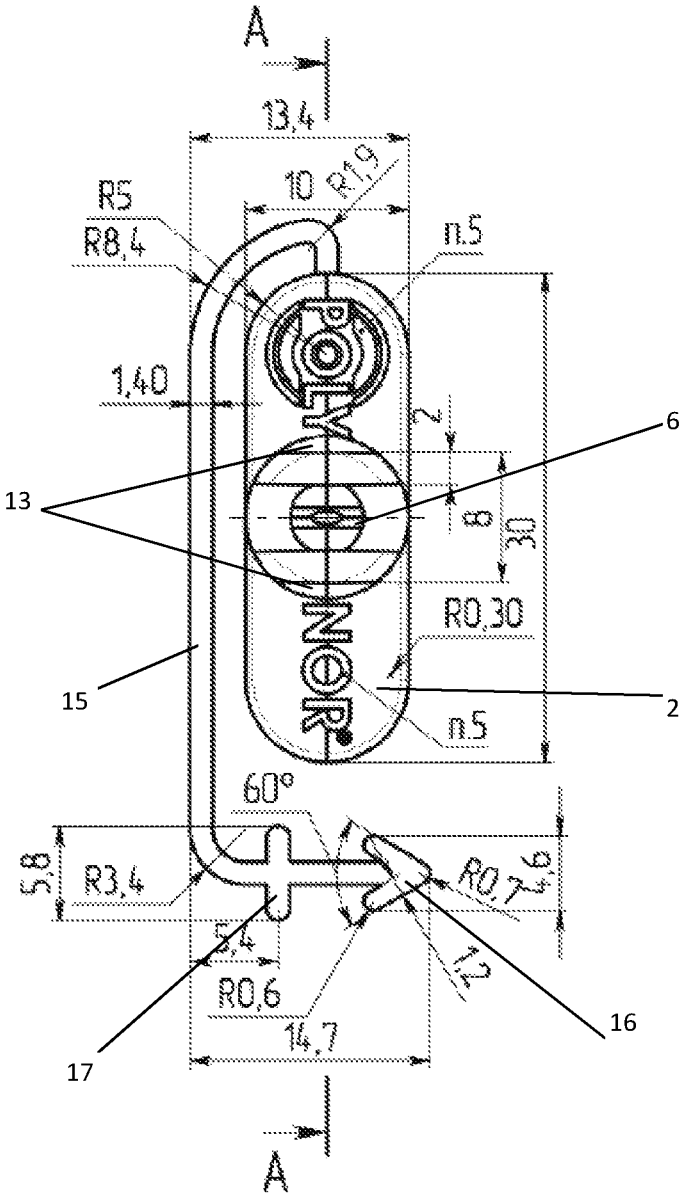
FIG. 1 shows a top view of the claimed invention.
Figure 2:
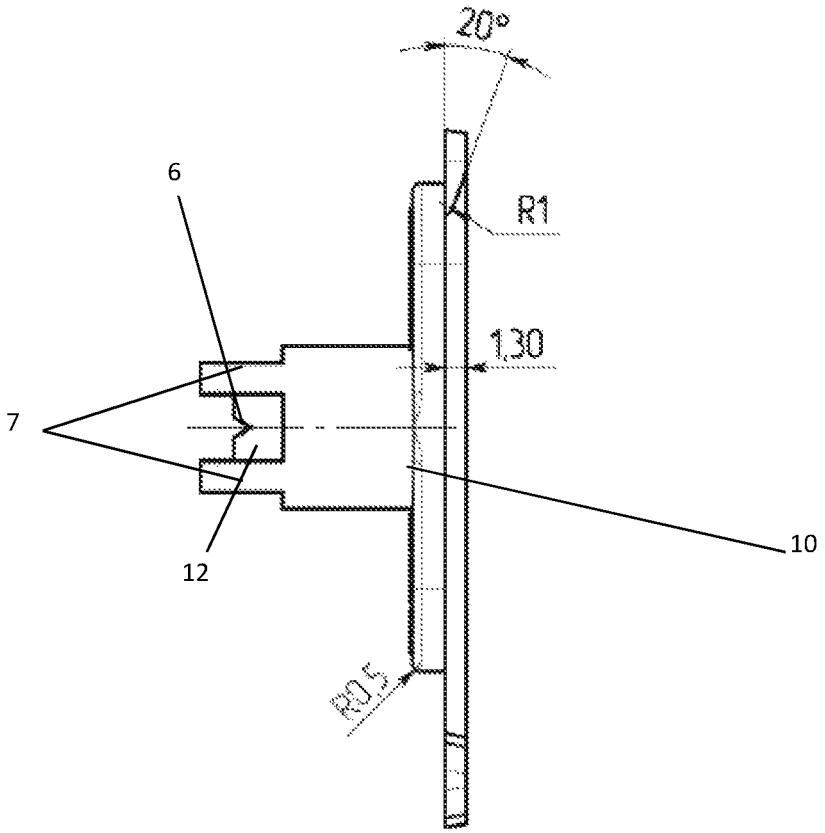
FIG. 2 shows a view of the first lateral side of the claimed invention.
Figure 3:
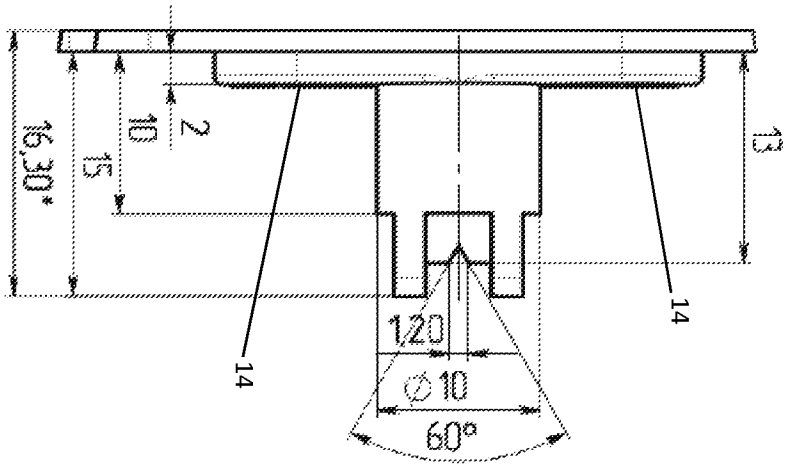
FIG. 3 shows a view of the second lateral side of the claimed invention.
Figure 4:
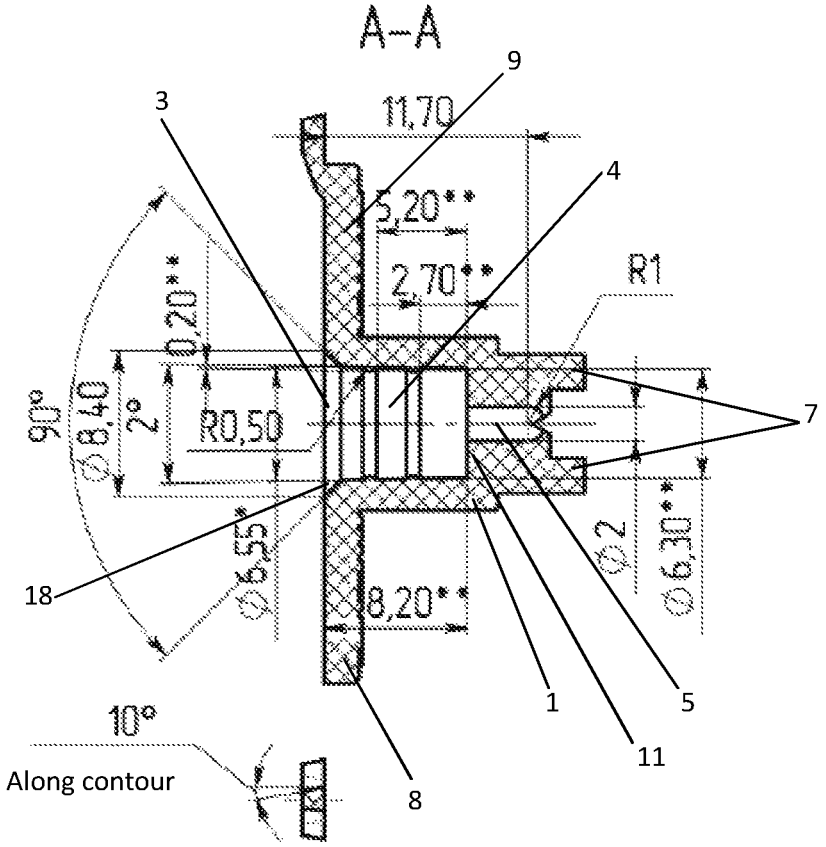
FIG. 4 shows a cross sectional view along A-A from FIG. 1.

The claimed invention is explained below by a specific exemplary embodiment which, nevertheless, does not preclude other embodiments, but clearly demonstrates that the totality of the essential features can achieve the stated technical effect solving the task of the invention.

The spraying nozzle comprises:

a cylindrical body 1;
a base 2;
a mounting aperture 3;
a cavity 4 in the cylindrical body 4;
a through bore 5 in a cylindrical shoulder;
a V-shaped recess 6;
plate-like protrusions 7;
oppositely arranged leaves 8 and 9 forming the base;
a first end 10 of the body;
a second end 11 of the body;
a cylindrical shoulder 12;
cuts 13 on the plate-like protrusions;
an anti-slip finish 14;
an attachment means 15;
a tip 16 of the attachment means;
a stop 17 in a form of a crossbar;
a circumferential cut 18 on the mounting aperture.

The claimed spraying nozzle of a spray gun intended for controlled aerosol spraying of a pressurized polyurethane material comprises the cylindrical body 1 provided with the base 2 with the mounting aperture 3 at the first end 10.

The mounting aperture 3 is made so as to extend into the cylindrical body 1 and forms the cavity 4 therein suitable for arranging a head of a gun that is attached to a container (an aerosol container) comprising an aerosol composition.

The base 2 is made in the form of the oppositely arranged leaves 8 and 9 that extend beyond the cylindrical body 1 and have a size suitable for resting user's fingers when the head of the gun is arranged within the cavity 4 of the cylindrical body of the nozzle.

The other end 11 of the body is provided with the cylindrical shoulder 12 which diameter is less than the diameter of the cylindrical body 1, and the through bore 5, as made therein, is in communication, at the region where a sprayed material exits a container, with a through, laterally non-closed V-shaped recess which width is made increasing toward the outlet for the sprayed material; at the other end of the through bore the through bore 5 is in communication with the cavity 4 of the cylindrical body.

The plate-like protrusions 7, which height is greater than the height of the cylindrical shoulder 12, abut against the lateral surfaces of the cylindrical shoulder 12.

The cuts 13 extending to the second end 11 of the cylindrical body 1 are made on the outer lateral sides of the plate-like protrusions 7.

The wall of the second end 11 has a thickness ensuring that the length of the through bore 5 made in the cylindrical shoulder 12 is greater than the height of the cylindrical shoulder 12.

The end portion of the mounting aperture 3, which adjoins the base 2 is provided with the circumferential cut 18.

The leaves 8 and 9 of the base 2 are provided with the anti-slip finish.

The spraying nozzle is provided with a means 15 for attaching it to an aerosol container when in inoperative condition.

The attachment means 15 for attachment to an aerosol container is made so as the spraying nozzle in a plan view has the shape of a staple or similar thereto.

The attachment means 15 is made in the form of a rod an end face of which is provided with an arrow-like tip, and the stop 17 made as a crossbar perpendicular to the rod is located opposite to the tip.

The claimed spraying nozzle of a spray gun can be operated as follows.

A gas-based single-component polyurethane composition in 1 L aerosol containers is used as an aerosol polyurethane composition.

The claimed spraying nozzle is put onto the head of the spray gun, and an aerosol container with a single-component polyurethane composition is screwed onto the spray gun.

A selected surface is treated in the result of user-controlled delivery of a polymer composition from an aerosol container and its orientation in space with the use of a unique configuration of the claimed spraying nozzle of a spray gun used for aerosol spraying of a single-component polyurethane material.

During operation of the claimed nozzle, namely during preparatory manipulations and its operation, the following occurs.

As stated in the Section "Summary of the Invention", the spraying nozzle 5 is made as the cylindrical body 1 which first end is provided with the base 2 with the mounting aperture 3. The base 2 is made in the form of the oppositely arranged leaves 8 and 9 extending beyond the cylindrical body and having the anti-slip finish 14, a size of the leaves being selected so as to be suitable for resting user's fingers when the head of a spray gun is introduced into the cavity 4 formed within the cylindrical body 1 of the nozzle. This structural embodiment provides a reliable rest for the user's fingers and allows their comfortable contact with the leave surfaces, thus creating a convenient support enabling to attach the spraying nozzle to the head of the spray gun quickly and easily prior to operation or during it when it is necessary to replace one spraying nozzle with a new one without interrupting the operation process for a long time; and the anti-slip finish ensures additional stability for the user's fingers in cases when the user can sweat during a labor-consuming work of applying an aerosol composition onto a surface.

The base 2 of the spraying nozzle is provided with the mounting aperture 3 extending into the cylindrical body 1 and forming the cavity 4 suitable for arranging the head of a spray gun therein. The dimensions of the cavity 4 are selected so as to ensure reliable and quick attachment and detachment of the head of a spray gun to/from it, the gun is subsequently attached to a container, particularly to a container with a single-component polyurethane composition.

The other end 11 of the cylindrical body 1 is provided with a cylindrical shoulder 12 having a diameter that is less than the diameter of the body 1. A through bore 5 is made in the cylindrical shoulder 12, which is in communication with the cavity 4 made in the cylindrical body 1 and, on its other end, in communication, at the region where a sprayed material exits a container, with a through V-shaped and laterally non-closed recess 6 which width is increased toward the outlet for the sprayed material. Furthermore, the wall of the second end 11 (where the cylindrical shoulder is made) has a thickness which can ensure that a length of the through bore 5 made in the cylindrical shoulder 12 is greater than the height of the cylindrical shoulder 12.

The configuration of the V-shaped and laterally non-closed recess 6 which width is increased toward the outlet for the sprayed material and which is in communication with the through bore 5 made in the cylindrical shoulder 12, in combination with the fact that the wall of the end 11 where the cylindrical shoulder 12 is made has a certain thickness ensuring that the length of the through bore made in the cylindrical shoulder is greater than the latter's height can ensure, together, the best orientation of a prepolymer directed jet in space for applying a sprayed composition onto a surface quickly and uniformly as well as can make it stable for "curing", that is, in other words, for separation of excess high-pressure gas, which is required for expelling a polymer. However, high-boiling hydrocarbon foaming agents, which facilitate further polymerization and foaming of a product applied onto a surface, are not removed. Thus, a polyurethane material may be applied onto a treated surface quickly, uniformly and with good quality.

According to the claimed invention, the oppositely arranged plate-like protrusions 7 adjoin the lateral surface of the cylindrical shoulder 12, the height of these protrusions being selected so as to be greater than the height of the cylindrical shoulder 12. The plate-like protrusions 7 protect the V-shaped, laterally non-closed recess 6 from damage when the recess 6 is joined with the head of the spray gun if an operator uses a hard surface as an abutment, and a contact with such surface, in the absence of such protective protrusions, may cause damage to the V-shaped recess which width is made increasing toward the outlet for the sprayed material.

The provision of the mounting aperture end, which abuts against the base 2 having an circumferential cut 18, ensures easier and smother positioning when joining the head of the spray gun and the spraying nozzle, respectively.

The spraying nozzle is provided with the means 15 for attaching it temporarily to an aerosol container or a spray gun, when the nozzle is in its inoperative position; this enables the user to join the nozzle quickly and easily prior to operation or replace it during operation, for example in a case where it is damaged or failed.

The attachment means for attachment to an aerosol container or to a spray gun is made so that the spraying nozzle in a plan view has the shape of a staple, which can create an impression that it is a cheap, conventional, readily accessible and simple in use product.

The claimed invention may be widely applicable in industry, namely, in construction industry, and, in particular, may be successfully used for applying heat insulation onto walls of dwelling complexes, outer facades of garages, apartment walls, balconies in multistoried buildings, large-size reservoirs used for oil storage and foundations of various structures.

What is claimed is:

1. A spraying nozzle of a spray gun for controlled aerosol spraying of a pressurized polyurethane material, comprising a cylindrical body wherein a first end is provided with a base having a mounting aperture extending into the cylindrical body and forming a cavity therein for arranging a head of the spray gun to be attached to a container with an aerosol composition, wherein the base is made in the form of leaves oppositely situated in the same plane and extending beyond the cylindrical body and having a size suitable for resting user's fingers when the head of the spray gun is introduced into the cavity, the second end of the cylindrical body is provided with a cylindrical shoulder having a diameter that is less than a diameter of the cylindrical body, the cylindrical body having a through bore which, at a region where the material being sprayed exits the container, communicates with a through V-shaped and laterally non-closed recess having a width that increases toward an outlet for the outlet for the sprayed material, oppositely arranged plate-like protrusions adjoin a lateral surface of the cylindrical shoulder, a height of said protrusions being greater than a height of the cylindrical shoulder, and cuts extending to the second end of the cylindrical body are made in outer lateral sides of said protrusions, the second end having a wall of sufficient thickness to ensure that a length of the through bore made in the cylindrical shoulder is greater than the height of the cylindrical shoulder, an end of the mounting aperture, which adjoins the base, has a circumferential cut, and the spraying nozzle is further provided with an attachment means used when in inoperative position.

2. The spraying nozzle of claim 1, wherein the attachment means allows attachment of the spraying nozzle temporarily to an aerosol container or the spray gun.

3. A spraying nozzle of a spray gun for controlled aerosol spraying of a pressurized polyurethane material, comprising a cylindrical body wherein a first end is provided with a base having a mounting aperture extending into the cylindrical body and forming a cavity therein for arranging a head of the spray gun to be attached to a container with an aerosol composition, wherein the base is made in the form of leaves oppositely situated in the same plane and extending beyond the cylindrical body and having a size suitable for resting user's fingers when the head of the spray gun is introduced into the cavity, the second end of the cylindrical body is provided with a cylindrical shoulder having a diameter that is less than a diameter of the cylindrical body the cylindrical body having a through bore which, at a region where the material being sprayed exits the container, communicates with a through V-shaped and laterally non-closed recess having a width that increases toward an outlet for the outlet for the sprayed material, oppositely arranged plate-like protrusions adjoin a lateral surface of the cylindrical shoulder, a height of said protrusions being greater than a height of the cylindrical shoulder, and cuts extending to the second end of the cylindrical body are made in outer lateral sides of said protrusions, the second end having a wall of sufficient thickness to ensure that a length of the through bore made in the cylindrical shoulder is greater than the height of the cylindrical shoulder, an end of the mounting aperture, which adjoins the base, has a circumferential cut, and the spraying nozzle is further provided with an attachment means used when in inoperative position, wherein the attachment means is made as a rod having an end portion provided with an arrow-like tip, and a stop made as a crossbar provided opposite to the arrow-like tip and perpendicular to the rod.

4. The spraying nozzle of claim 1, wherein the leaves of the base are provided with an anti-slip finish.

5. The spraying nozzle of claim 3, wherein the leaves of the base are provided with an anti-slip finish.

* * * * *